US009272883B2

(12) United States Patent
Behnke

(10) Patent No.: US 9,272,883 B2
(45) Date of Patent: Mar. 1, 2016

(54) METHOD AND CONTROL ASSEMBLY FOR OPERATING AT LEAST TWO LIFTING DEVICES, IN PARTICULAR CRANES, IN PARALLEL

(75) Inventor: Klaus Behnke, Dortmund (DE)

(73) Assignee: Terex MHPS GmbH, Duesseldorf (DE)

( * ) Notice: Subject to any disclaimer, the term of this patent is extended or adjusted under 35 U.S.C. 154(b) by 201 days.

(21) Appl. No.: 14/240,874

(22) PCT Filed: Aug. 23, 2012

(86) PCT No.: PCT/EP2012/066454

§ 371 (c)(1),
(2), (4) Date: Feb. 25, 2014

(87) PCT Pub. No.: WO2013/030092

PCT Pub. Date: Mar. 7, 2013

(65) Prior Publication Data

US 2014/0251935 A1 Sep. 11, 2014

(30) Foreign Application Priority Data

Aug. 26, 2011 (DE) ..... 10 2011 053 014

(51) Int. Cl.
*B66C 13/40* (2006.01)
*B66C 13/22* (2006.01)
*B66C 13/18* (2006.01)

(52) U.S. Cl.
CPC ..... *B66C 13/22* (2013.01); *B66C 13/18* (2013.01); *B66C 13/40* (2013.01)

(58) Field of Classification Search
CPC ..... B66C 13/18; B66C 13/40; B66C 13/22
USPC ..... 701/50, 1; 212/285, 284
See application file for complete search history.

(56) References Cited

U.S. PATENT DOCUMENTS 6,315,079 B1 11/2001 Berends et al.
6,837,363 B2 1/2005 Munzebrock et al.

(Continued)

FOREIGN PATENT DOCUMENTS

CN 201169498 Y 12/2008
DE 3147158 6/1983

(Continued)

OTHER PUBLICATIONS

Translation of PCT International Preliminary Report on Patentability for corresponding PCT Application No. PCT/EP2012/066454 dated Mar. 4, 2014.

(Continued)

*Primary Examiner* — Tan Q Nguyen
(74) *Attorney, Agent, or Firm* — Gardner, Linn, Burkhart & Flory, LLP

(57) ABSTRACT

A method and control assembly are provided for operating at least two lifting devices, such as cranes, in group and normal operation modes. Each lifting device has a control system connected to a control switch, and the lifting devices are controlled through a common bus. In group operation, the lifting devices are jointly controlled through the bus by one switch. To operate at least two lifting devices in parallel, one of the switches is active in the group operation and the remaining switch or switches are passive. To prepare for group operation, normal operation is deselected by all but one of the control switches to release a remaining switch for log-in to the active state for group operation. To prepare for normal operation, group operation is deselected and normal operation is selected at the active switch before the other switch or switches are released for logging into normal operation.

20 Claims, 1 Drawing Sheet

(56) References Cited

U.S. PATENT DOCUMENTS

| | | | | |
|---|---|---|---|---|
| 2003/0210154 | A1 | 11/2003 | Bredow et al. | |
| 2003/0210254 | A1 | 11/2003 | Doan et al. | |
| 2008/0053945 | A1 | 3/2008 | Schneider et al. | |
| 2011/0112731 | A1* | 5/2011 | Harada | B66C 13/12 701/50 |
| 2012/0059555 | A1* | 3/2012 | Bixel | B66C 13/22 701/50 |
| 2014/0107881 | A1* | 4/2014 | Sugiyama | B60K 6/12 701/22 |

FOREIGN PATENT DOCUMENTS

| | | |
|---|---|---|
| DE | 9115537 | 5/1993 |
| DE | 102006040782 | 3/2008 |
| EP | 1343128 | 9/2003 |
| EP | 1380533 | 1/2004 |
| WO | WO 98/30488 | 7/1998 |

OTHER PUBLICATIONS

International Search Report for corresponding PCT Application No. PCT/EP2012/066454 dated Oct. 22, 2012.

Written Opinion for corresponding PCT Application No. PCT/EP2012/066454.

* cited by examiner

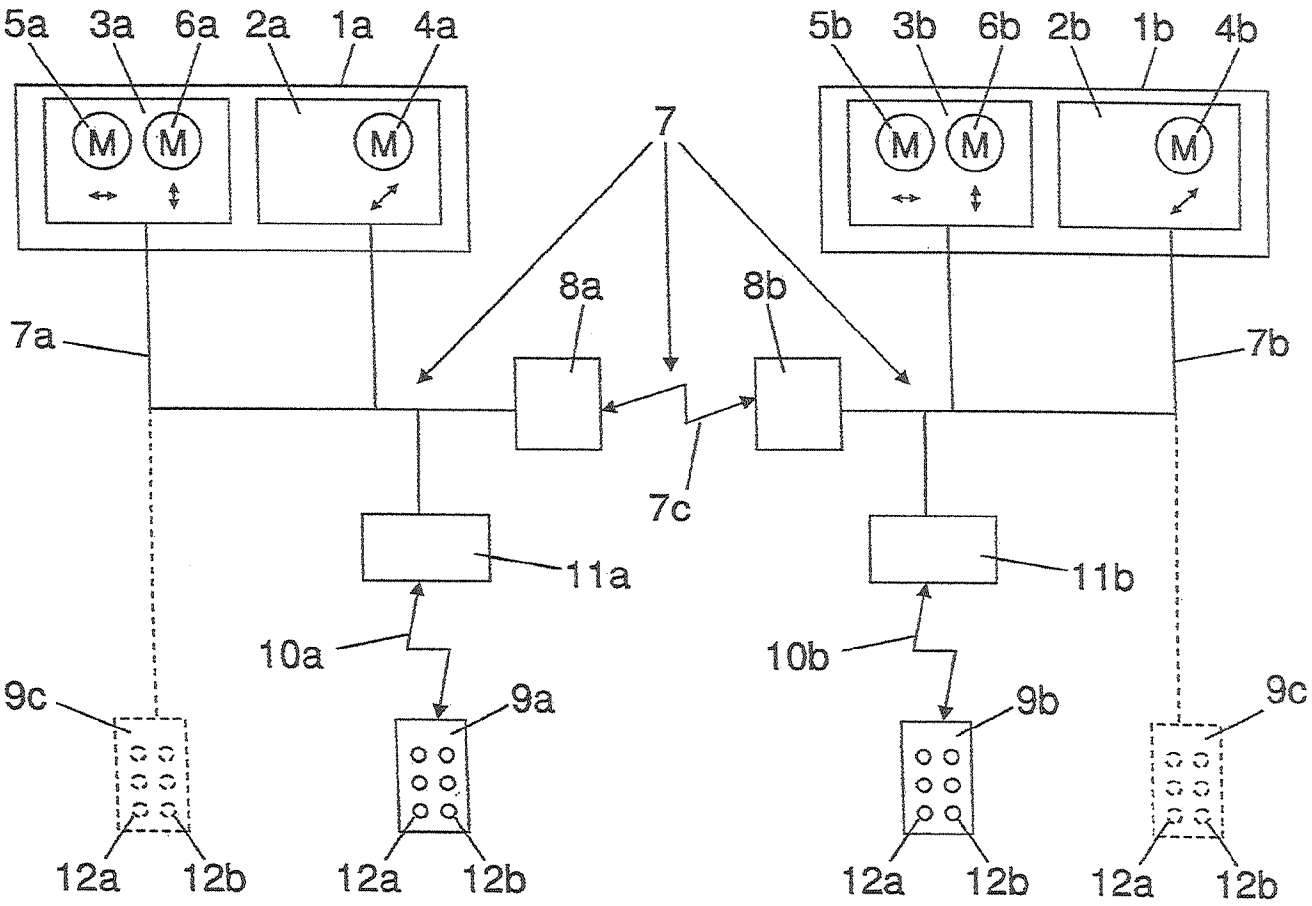
4b
1b
2b
6b
3b
5b
7b
9c
12b
12a
11b
9b
12b
12a
10b
8b
7
7c
8a
11a
9a
12b
12a
10a
4a
1a
2a
6a
3a
5a
7a
9c
12b
12a

METHOD AND CONTROL ASSEMBLY FOR OPERATING AT LEAST TWO LIFTING DEVICES, IN PARTICULAR CRANES, IN PARALLEL

CROSS REFERENCE TO RELATED APPLICATIONS

The present application claims the priority benefits of International Patent Application No. PCT/EP2012/066454, filed on Aug. 23, 2012, and also of German Patent Application No. DE 10 2011 053 014.2, filed on Aug. 26, 2011, which are hereby incorporated herein by reference in their entireties.

FIELD OF THE INVENTION

The present invention relates to a method for operating at least two lifting devices, in particular cranes, in group operation and in normal or individual operation.

BACKGROUND OF THE INVENTION

It is generally known to use two crane lifting gears at the same time in so-called tandem operation for lifting and lowering heavy and/or long loads. In this case, the load is suspended from two load-receiving means which are each raised or lowered by a dedicated crane lifting gear. The most varied circumstances may cause the load to shift from the horizontal position. In the case of, for example, long goods which are conventionally suspended from the load-receiving means via slinging means such as loops, such a skewed position of the load could lead to the load slipping out of the slinging means. Such dangerous conditions need to be avoided. Conventionally, each of the crane lifting gears can be operated via a control switch. One of the two control switches is then arranged for tandem operation. A change to tandem operation or out of tandem operation is then effected only by using this control switch. In this way, dangerous situations can occur which must be avoided. On the one hand, the change in the type of operation is made without feedback, which means that the operator must trust that tandem operation is activated and, on the other hand, immediate intervention in the operation of the other crane is made by the control switch which is arranged for tandem operation, which can lead to dangerous situations at that location.

On this subject, it is known, for example, from the German laid open document DE 31 47 158 A1 to connect two crane lifting gears for tandem operation through a common control device. This control device is intended to prevent the skewed position described above. To this end, a sensor is disposed on a spreader which is suspended from load-receiving means of both crane lifting gears. By means of this sensor, the position of the spreader is determined. In the event that the spreader leaves its desired horizontal position, tandem operation is exited, one of the two crane lifting gears is stopped and the other crane lifting gear is used to move the spreader back into the horizontal position.

Furthermore, an indoor travelling crane is known from European patent EP 1 380 533 A1, the trolley drive, crane travel drive, lifting gear and control switch of which are connected to one another through a bus. Operational and safety signals are transmitted and received through the bus.

From the German utility model DE 91 15 537 U1 a single crane control system for a single crane and a tandem crane control system for a first crane with a first trolley and for a second crane with a second trolley are already known. For tandem crane control a bidirectional transfer bus is provided, through which, by means of control switches attached thereto, both cranes and their trolleys can be controlled. Controlling a single crane of the two cranes within the tandem crane control system is not described.

Furthermore, the German patent application DE 10 2006 040 782 A1 discloses tandem operation of two cranes within a safety system and separate control of the cranes in single operation. Each of the cranes has an on-board CAN-bus to which a control system is attached. For necessary corrections in tandem operation, the tandem operation is deselected, the correction carried out and tandem operation reselected.

SUMMARY OF THE INVENTION

The method and control assembly of the present invention provides a control device for safe parallel operation of at least two lifting devices, in particular cranes.

According to one form of the present invention, a method is provided for operating at least two lifting devices, in particular cranes, in group operation and in normal or individual operation, wherein each lifting device has an electric lifting gear motor with an associated control system which is connected to a control switch, wherein the at least two lifting devices are controlled through a common bus, wherein in group operation the at least two lifting devices are jointly controlled through the bus by one of the control switches.

According to another form, a control assembly is provided for operating at least two lifting devices, in particular at least two cranes, in group operation and in normal operation, wherein each lifting device has an electric lifting gear motor with an associated control system which is connected to a control switch.

In accordance with another form of the present invention, a safe and simple method for operating at least two lifting devices, in particular of at least two cranes, in group operation and in normal operation, wherein each lifting device has an electric lifting gear motor with an associated control system which is connected to a control switch, wherein the at least two lifting devices are controlled through a common bus, wherein in group operation the at least two lifting devices are jointly controlled through the bus by one of the control switches, is achieved in that in group operation one of the control switches is in an active state and the remaining control switch(es) is/are in a passive state, that in preparation for group operation, normal operation is deselected by all but one of the control switches, which are in normal operation, then group operation is logged onto by the remaining control switch and this remaining control switch is then in the active state in group operation, and in preparation for normal operation, group operation is deselected by the control switch in the active state in group operation, and normal operation is selected, then the other control switch or the other control switches in passive group operation are logged onto for normal operation.

In one advantageous embodiment, the control switch in the active state in group operation is operated in three operational modes, and the operational modes are defined as tandem operation in which a plurality of lifting devices are controlled in parallel by the control switch in the active state, as first single operation in which only a first one of the lifting devices is controlled by the control switch in the active state, and as second single operation in which only a second one of the lifting devices of the control switches in the active state is controlled.

In accordance with another form of the present invention, a safe and simple control assembly is provided for operating at least two lifting devices, in particular of at least two cranes, in group operation and in normal operation, wherein each lifting device has an electric lifting gear motor with an associated control system which is connected to a control switch, wherein the at least two lifting devices can be controlled through a common bus, wherein in group operation the at least two lifting devices can be jointly controlled through the bus by one of the control switches, is achieved in that in group operation one of the control switches is in an active state and the remaining control switch(es) is/are in a passive state, that in preparation for group operation, normal operation can be deselected by all but one of the control switches, which are in normal operation, before group operation can be logged onto by the remaining control switch, and this control switch is then active in group operation, and in preparation for normal operation, group operation can be deselected by the active control switch in group operation, and normal operation can be selected before the other control switch or the other control switches in passive group operation can be logged onto for normal operation. Therefore for group operation, the change between normal operation and group operation, the logging-on and logging-off of the control switches and the locking of the control switches, the provided control systems and the switching logic provided therein can be used. This safe, two-step switch-over between normal and group operation by log-on and log-off sequences means that no specific control switches arranged for tandem operation are required. The fact that two steps are always required to change between group operation and normal operation provides a high level of safety. A log-off sequence is triggered at one of the control switches, the control systems recognise this request and wait for the log-on sequence from the other control switch. After corresponding checks and communication by the control systems with respect to one another, the change in the type of operation then takes place.

In a particularly advantageous manner, provision is made that the control switch in the active state in group operation can be operated in three operational modes and the operational modes are defined as tandem operation in which the control switch in the active state controls a plurality of lifting devices in parallel, as first single operation in which the control switch in the active state controls only a first one of the lifting devices, and as second single operation in which the control switch in the active state controls only a second one of the lifting devices. Therefore positional corrections of the load in group operation can easily be carried out without having to return to normal operation. The control switch selected for group operation remains in group operation in the active state. Transition through the log-off and log-on sequences no longer takes place.

In a particularly advantageous embodiment, the bus is divided per lifting device into a conducted bus portion and into a wireless bus between the lifting devices.

In conjunction with the bus architecture, the control systems and the control switches are connected to the bus.

In a particularly advantageous embodiment, provision is made that the at least two lifting devices are formed as cranes, the cranes have—in addition to the lifting gear motors—crane travel motors and trolley travel motors, the control systems are allocated to the lifting gear motors and the trolley travel motors, crane control systems are allocated to the crane travel motors and the crane control systems are connected to the common bus. The control system of the cranes is constructed in a decentralised manner and divided into crane control system and trolley control system modules which each react in their own right to the respective commands of the control switches in order to switch over between normal and group operation.

Particularly safe and simple operation is provided when the logging-on and -off of the control switches is monitored by the control systems. The control systems in this case can also have corresponding logic in order to coordinate logging-on and -off.

These and other objects, advantages and features of this invention will become apparent upon review of the following specification in conjunction with the drawings.

BRIEF DESCRIPTION OF THE DRAWING

FIG. 1 is a schematic view of two bridge cranes connected together for group operation.

DESCRIPTION OF THE PREFERRED EMBODIMENTS

Referring now to the drawing and the illustrative embodiment depicted therein, a first crane 1*a* and a second crane 1*b* (FIG. 1) are each formed as a bridge crane which can travel along crane travel rails, not shown. In a conventional manner, the bridge crane has a horizontal crane girder along which a crane trolley with a lifting gear can travel. The first crane 1*a* has a first crane control system 2*a* and a first trolley control system 3*a*; the second crane 1*b* correspondingly has a second crane control system 2*b* and a second trolley control system 3*b*. The first and second crane control systems 2*a*, 2*b* are respectively intended to control the first and second crane travel motors 4*a*, 4*b*. By means of the first and second trolley travel control systems 3*a*, 3*b*, first and second trolley travel motors 5*a*, 5*b* and first and second lifting gear motors 6*a*, 6*b* are controlled. The lifting gears (not shown) allocated to the lifting gear motors 6*a*, 6*b* are designed as cable hoists. It is fundamentally also possible to design the lifting gears as chain hoists. A mixed operation with chain and cable hoists is also feasible. The aforementioned motors 4*a*, 4*b*, 5*a*, 5*b*, 6*a* and 6*b* are designed as electric motors.

In order to be able to transmit and receive operational signals and safety signals, the crane control systems 2*a*, 2*b* and the trolley control systems 3*a*, 3*b* are each connected to a bus 7 by bus coupling modules (not shown). This bus 7 preferably operates with the CAN protocol. Furthermore, the bus 7 is formed from a first wired bus portion 7*a* locally in the region of the first crane 1*a*, from a second wired bus portion 7*b* locally in the region of the second crane 1*b* and a wireless bus 7*c* which connects the first bus portion 7*a* and the second bus portion 7*b* to one another. For this purpose, a first coupling module 8*a* is connected to the first bus portion 7*a* and a second coupling module 8*b* is connected to the second bus portion 7*b*. By means of the coupling modules 8*a*, 8*b* the signals on the first bus portion 7*a* and the second bus portion 7*b* are converted into wireless signals and transmitted between the coupling modules 8*a*, 8*b* via transmitter and receiver components. By means of the coupling modules 8*a*, 8*b* all bus users such as the crane control systems 2*a*, 2*b*, the trolley control systems 3*a*, 3*b* and also directly or indirectly the first and the second control switches 9*a*, 9*b* are therefore connected to a common bus 7. The wireless bus 7*c* is preferably designed as a radio bus. It is also possible to provide an infrared bus.

The crane control systems 2*a*, 2*b* and the trolley control systems 3*a*, 3*b* are provided with generally known (but not illustrated) power switches, safety switches, sensors, switching logic and bus coupling modules. The bus coupling modules can be components of the switching logic.

Furthermore, a first wireless control switch 9*a*, which is allocated to the first crane 1*a*, and a second wireless control switch 9*b*, which is allocated to the second crane 1*b*, are provided. The control switch 9*a* is connected via a first wireless connection 10*a* to a first switch coupling module 11. The wireless connection 10*a* is bidirectional. This also applies for the second control switch 9*b*, to which a second wireless connection 10*b* and a second switch coupling module 11*b* are allocated. The first switch coupling module 11*a* and the second switch coupling module 11*b* are attached to the bus 7 as further bus users. The control switches 9*a*, 9*b* are equipped in the conventional manner with a plurality of push button elements in order to control the individual movement directions and speed stages of the crane travel motor 4*a*, 4*b*, of the trolley travel motors 5*a*, 5*b* and of the lifting gear motors 6*a*, 6*b* which may be present.

Alternatively to the two wireless control switches 9*a*, 9*b* and the two switch coupling modules 11*a*, 11*b*, cable control switches 9*c*, shown in a broken line in FIG. 1, can be provided. The cable control switches 9*c* are formed as pendant switches and connected to the bus 7 as bus user directly via the supply line thereof.

The cranes 1*a*, 1*b* described above can each be operated individually and independently of one another via their control switches 9*a*, 9*b*. This manner of operation is designated as normal operation hereinunder. In normal operation, the first control switch 9*a* is then allocated to the first crane 1*a* and the second control switch 9*b* to the second crane 1*b*. Both control switches 9*a*, 9*b* are in an active state.

It is also possible, optionally by means of one of the two control switches 9*a*, 9*b*, to operate both cranes 1*a*, 1*b* in so-called group operation in parallel or also individually. In group operation, one of the first or second control switches 9*a*, 9*b* is in an active state and the other of the first or second control switches 9*a*, 9*b* is in a passive state. In the passive state, the respective control switch 9*a*, 9*b* is locked in terms of operation, i.e. all input signals are ignored. In contrast, it is possible by means of a control switch 9*a*, 9*b* in the active state to transmit control signals to the allocated crane or both allocated cranes 1*a*, 1*b*. In group operation, three operational modes are then possible, namely tandem operation, first single operation and second single operation. In tandem operation, the control switch 9*a*, 9*b* in the active state is allocated simultaneously to both cranes 1*a*, 1*b*, which means that control commands from the control switch 9*a*, 9*b* in the active state are transmitted in parallel to the motors 4*a*, 4*b*, 5*a*, 5*b*, 6*a* and 6*b*. Then, the motors 4*a*, 4*b*, 5*a*, 5*b*, 6*a* and 6*b* of the first crane 1*a* move in synchronism with those of the second crane 1*b*. With both cranes 1*a*, 1*b* in tandem operation, long and heavy loads can be lifted and moved jointly. In tandem operation, the cranes 1*a*, 1*b* are then each controlled in synchronism via one of the two control switches 9*a*, 9*b*. In tandem operation and therefore also in group operation, operational states can occur in which parallel operation of the motors 4*a*, 4*b*, 5*a*, 5*b*, 6*a* and 6*b* must be exited in order, shortly thereafter or later, to resume tandem operation. Group operation with a common control switch 9*a* in the active state is then not terminated. This can be the case when, during travel of both cranes 1*a*, 1*b* in tandem operation, a correction of the position of the load is required to avoid a skewed position. A correction of the relative positions of the cranes 1*a*, 1*b* with respect to one another, in particular the crane girders and/or crane trolleys thereof, is feasible. For such corrections, a change is made from tandem operation to first single operation or second single operation. In first single operation, corresponding to group operation, one of the control switches 9*a*, 9*b* continues to be in the active state and the other control switch 9*b*, 9*a* in the passive state. Furthermore, only the first crane 1*a* receives control commands and is in an active state and the second crane 1*b* receives no control commands and is in a passive state. Therefore the first crane 1*a* can be moved relative to the second crane 1*b*. The second single operation corresponds to the first with the difference that the first crane 1*a* is in the passive state and the second crane 1*b* is in the active state.

In order to be able to change between normal operation and group operation, a log-on button 12*a* and a log-off button 12*b* are disposed on both control switches. Instead of specific log-on and log-off buttons 12*a*, 12*b*, the log-on and log-off process can also be triggered by predetermined button sequences.

By actuation of a log-off button 12*b* of the first or second control switch 9*a*, 9*b*, in a first step a termination of normal operation and logging onto group operation is signalled to the bus 7 and in the direction of the crane travel control systems 2*a*, 2*b* and the trolley control systems 3*a*, 3*b*, and this control switch 9*a*, 9*b* now enters the passive state.

In addition to actuation of the log-off button 12*b*, the emergency/stop button can also preferably be pressed or can be at the end of a log-off sequence. It is therefore also possible to recognise visually at the control switch 9*a*, 9*b* by reason of the emergency/stop button having been pressed that this control switch 9*a*, 9*b* is in the passive state.

Then in a second step, by actuation of the log-on button 12*a* of the other control switch 9*b*, 9*a* the completed log-on for group operation through the bus 7 in the direction of the crane travel control systems 2*a*, 2*b* and the trolley control systems 3*a*, 3*b* is adopted and this control switch 9*b*, 9*a* is then accepted by all crane travel control systems 2*a*, 2*b* and trolley control systems 3*a*, 3*b* as a source of control and safety signals.

By the logging-off of one of the two control switches 9*a*, 9*b* and the logging-on of the other control switch 9*b*, 9*a*, the crane travel control systems 2*a*, 2*b* and the trolley control systems 3*a*, 3*b* have the information that group operation is now switched on and only control and safety signals from the other control switch 9*b*, 9*a* in the active state are accepted. Since such group operation is assumed by two cranes 1*a*, 1*b* in a planned manner, both cranes 1*a*, 1*b* have previously been oriented with respect to the load to be handled. By means of the above-described single operation in group operation the cranes 1*a*, 1*b* can also be moved relative to one another without exiting group operation. Provision can also be made that the other control switch 9*b*, 9*a* can only enter the active state of group operation when none of the buttons of this control switch 9*a*, 9*b* are actuated.

In this group operation, all crane control systems 2*a*, 2*b* and trolley control systems 3*a*, 3*b* are then allocated to one of the two control switches 9*a*, 9*b*, which is in the active state, and the crane travel motors 4*a*, 4*b*, trolley travel motors 5*a*, 5*b* and lifting gear motors 6*a* and 6*b* are each controlled in synchronism so that both cranes 1*a*, 1*b* can be moved in the crane and trolley travel direction in synchronism with one another and a load can by lowered in synchronism by both cranes 1*a*, 1*b*.

In order to terminate group operation, the log-off button 12*b* is actuated on the control switch 9*a* in the active state. A corresponding log-off signal is transmitted through the bus 7 to the crane travel control systems 2*a*, 2*b* and the trolley control systems 3*a*, 3*b*. Then, in the case of the control switch 9*a*, 9*b* which has previously been in the passive state, the emergency/stop button is deactivated and the log-on button 12*a* is actuated. A corresponding log-on signal is transmitted through the bus 7 to the crane travel control systems 2*a*, 2*b* and the trolley control systems 3*a*, 3*b*. Both control switches 9*a*, 9*b* are then in a state of single operation. Therefore, both cranes 1*a*, 1*b* are operationally separated from one another but continue to be connected to one another through the bus 7 in order to be able to react to a future request for group operation.

In conjunction with the log-on and log-off sequences for changing between normal and group operation and vice versa, the steps of deselection of one of the two control switches 9*a*, 9*b*, which is followed by logging-on through the other of the two control switches 9*a*, 9*b*, are observed, recognised, monitored and checked for reliability by the crane travel control systems 2*a*, 2*b* and the trolley control systems 3*a*, 3*b*. For this purpose, the crane travel control systems 2*a*, 2*b* and the trolley control systems 3*a*, 3*b* interchange. Only log-off and log-on sequences of a predetermined type are considered and also the succession of the deselection and log-on steps is checked in order to achieve a safe change in the type of operation. Only after completed log-off in a first step and log-on in terms of acceptance in a second step does a change of type of operation take place. In this way, a high level of safety is achieved. In the crane travel control systems 2*a*, 2*b* and the trolley control systems 3*a*, 3*b* the log-off and log-on sequences are initialised so that a corresponding recognition, check and, finally, the actual switch-over to change the type of operation in the crane travel control systems 2*a*, 2*b* and the trolley control systems 3*a*, 3*b* can take place as soon as the correct succession and type of log-off and log-on sequences has been recognised.

The control system of the cranes 1*a*, 1*b* is constructed in a decentralised manner and divided into the modules of the crane travel control system 2*a*, 2*b* and trolley control system 3*a*, 3*b* which each react in their own right to the respective commands of the control switches 9*a*, 9*b* in order to switch over between normal and group operation. For the switch-over between normal and group operation and in group operation to tandem operation and the two single types of operation, the available crane travel control system 2*a*, 2*b* and the available trolley control system 3*a*, 3*b* are therefore used.

Although in the present exemplified embodiment the invention is described with the aid of a group operation of two cranes 1*a*, 1*b*, the principle of the invention can also easily be applied to parallel operation with more than two cranes 1*a*, 1*b*.

Changes and modifications to the specifically described embodiments may be carried out without departing from the principles of the present invention, which is intended to be limited only by the scope of the appended claims as interpreted according to the principles of patent law including the doctrine of equivalents.

The invention claimed is:

1. A method for operating at least two lifting devices, in particular cranes, in group operation and in normal operation modes, said method comprising:

controlling the at least two lifting devices through a common bus, wherein each of the lifting devices comprises a respective electric lifting gear motor with a respective control system that is connected to a respective control switch, wherein the control switches are selectable between normal operation and group operation;

preparing for changing from normal operation to group operation by deselecting normal operation at all but a first of the control switches that are in a normal operation, whereby only the first control switch remains in normal operation;

logging on to group operation with the first control switch, thereby changing the first control switch to an active state for group operation, wherein the other control switch or switches that are deselected from normal operation are in a passive state in group operation;

jointly controlling the at least two lifting devices though the common bus with the first control switch;

preparing for changing from group operation to normal operation by deselecting group operation and selecting normal operation at the first control switch; and logging on to normal operation with the other control switch or switches.

2. The method of claim 1, wherein the first control switch in the active state for group operation is operable in three operational modes comprising (i) tandem operation in which the at least two lifting devices are controlled in parallel by the first control switch in the active state, (ii) first single operation in which only a first one of the lifting devices is controlled by the first control switch in the active state, and (iii) second single operation in which only a second one of the lifting devices is controlled by the first control switch in the active state.

3. The method of claim 2, further comprising monitoring the logging-on and a logging-off of the first and second control switches with the first and second control systems.

4. The method of claim 3, wherein the first and second lifting devices further comprise respective crane travel motors and respective trolley travel motors, and the control assembly further comprises first and second crane control systems that are connected to the common bus, said method further comprising:

allocating the first and second control systems to the respective lifting gear motors and to the respective trolley travel motors; and allocating the first and second crane control systems to the crane travel motors and the crane control systems.

5. The method of claim 2, wherein the first and second lifting devices further comprise respective crane travel motors and respective trolley travel motors, and the control assembly further comprises first and second crane control systems that are connected to the common bus, said method further comprising:

allocating the first and second control systems to the respective lifting gear motors and to the respective trolley travel motors; and allocating the first and second crane control systems to the crane travel motors and the crane control systems.

6. The method of claim 1, further comprising monitoring the logging-on and a logging-off of the first and second control switches with the first and second control systems.

7. The method of claim 3, wherein the first and second lifting devices further comprise respective crane travel motors and respective trolley travel motors, and the control assembly further comprises first and second crane control systems that are connected to the common bus, said method further comprising:

allocating the first and second control systems to the respective lifting gear motors and to the respective trolley travel motors; and allocating the first and second crane control systems to the crane travel motors and the crane control systems.

8. The method of claim 1, wherein the first and second lifting devices further comprise respective crane travel motors and respective trolley travel motors, and the control assembly further comprises first and second crane control systems that are connected to the common bus, said method further comprising:

allocating the first and second control systems to the respective lifting gear motors and to the respective trolley travel motors; and allocating the first and second crane control systems to the crane travel motors and the crane control systems.

9. A control assembly for operating at least two lifting devices, in particular cranes, in group operation and in normal operation modes, wherein each lifting device has an electric lifting gear motor with an associated control system that allows the at least two lifting devices to be jointly controlled through a common bus, said control assembly comprising:

a first control switch operatively connected to a first of the control systems associated with a first of the at least two lifting devices, wherein the first control switch is selectable between normal operation and group operation;

a second control switch operatively connected to a second of the control systems associated with a second of the at least two lifting devices, wherein the second control switch is selectable between normal operation and group operation;

wherein when normal operation is deselected at the second control switch so that only the first control switch remains in normal operation, the first control switch is operable for logging on to group operation, whereby the control systems are configured for group operation in which the first and second lifting devices are jointly controllable by the first control switch via the common bus;

wherein when the control systems are configured for group operation so that the first and second lifting devices are jointly controllable by the first control switch, the first control switch is in an active state and the second control switch is in a passive state; and wherein when group operation is deselected at the first control switch and normal operation is selected at the first control switch, the second control switch is operable for logging on to normal operation, whereby the control systems are configured for normal operation in which the first and second lifting devices are independently and respectively controllable by the first control switch and the second control switch.

10. The control assembly of claim 9, wherein the first control switch in the active state in group operation is operable in three operational modes comprising (i) tandem operation in which the first control switch in the active state controls the at least two lifting devices in parallel, (ii) first single operation in which the first control switch in the active state controls only the first lifting device, and (iii) second single operation in which the first control switch in the active state controls only the second lifting device.

11. The control assembly of claim 10, wherein the common bus comprises a respective conducted bus portion associated with each of the at least two lifting devices, and a wireless bus in communication between the at least two lifting devices.

12. The control assembly of claim 11, wherein the first and second control systems are operable to monitor the logging-on and a logging-off of the first and second control switches.

13. The control assembly of claim 12, wherein the first and second lifting devices further comprise respective crane travel motors and respective trolley travel motors, wherein the first and second control systems are allocated to the respective lifting gear motors and to the respective trolley travel motors, and wherein the control assembly further comprises first and second crane control systems that are connected to the common bus and are allocated to the crane travel motors and the crane control systems.

14. The control assembly of claim 10, wherein the first and second control systems are operable to monitor the logging-on and a logging-off of the first and second control switches.

15. The control assembly of claim 10, wherein the first and second lifting devices further comprise respective crane travel motors and respective trolley travel motors, wherein the first and second control systems are allocated to the respective lifting gear motors and to the respective trolley travel motors, and wherein the control assembly further comprises first and second crane control systems that are connected to the common bus and are allocated to the crane travel motors and the crane control systems.

16. The control assembly of claim 9, wherein the common bus comprises a respective conducted bus portion associated with each of the at least two lifting devices, and a wireless bus in communication between the at least two lifting devices.

17. The control assembly of claim 16, wherein the first and second control systems are operable to monitor the logging-on and a logging-off of the first and second control switches.

18. The control assembly of claim 9, wherein the control systems and the control switches are connected to the common bus.

19. The control assembly of claim 9, wherein the first and second control systems are operable to monitor the logging-on and a logging-off of the first and second control switches.

20. The control assembly of claim 9, wherein the first and second lifting devices further comprise respective crane travel motors and respective trolley travel motors, wherein the first and second control systems are allocated to the respective lifting gear motors and to the respective trolley travel motors, and wherein the control assembly further comprises first and second crane control systems that are connected to the common bus and are allocated to the crane travel motors and the crane control systems.

* * * * *